US005520478A

United States Patent [19]

Yin-Lung

[11] Patent Number: 5,520,478

[45] Date of Patent: May 28, 1996

[54] LANDSCAPED URBAN ROAD INTERSECTION

[76] Inventor: Yang Yin-Lung, P.O. Box 28-6, Kaohsiung, Taiwan

[21] Appl. No.: 345,652

[22] Filed: Nov. 29, 1994

[51] Int. Cl.[6] ..... E01C 1/04

[52] U.S. Cl. ..... 404/1; 52/174

[58] Field of Search ..... 404/1; 52/174, 52/175, 176

[56] References Cited

U.S. PATENT DOCUMENTS 3,685,221 8/1972 Mangan ..... 52/175

5,049,000 9/1991 Mier et al. ..... 404/1

*Primary Examiner*—Ramon S. Britts

*Assistant Examiner*—Pamela A. O'Connor

*Attorney, Agent, or Firm*—Lowe, Price, LeBlanc & Becker

[57] ABSTRACT

A road intersection comprising a main road having at least two traffic lanes in each direction and an inside and an outside lane in each direction having parallel center lines, and a secondary road having at least one traffic lane in each direction intersecting said main road. There is provided a traffic island in the intersection extending parallel to and disposed between the inside lanes of the main road so as to block the lanes of the secondary road. A pair of opposed detour roads is disposed on either side of the intersection, and each detour road is located vertically above or below the main road in a manner such that the land space lying vertically under each detour road is substantially within the boundaries of the land space lying vertically under the main road.

6 Claims, 2 Drawing Sheets

LANDSCAPED URBAN ROAD INTERSECTION

FIELD OF THE INVENTION

This invention concerns improvements in or relating to road intersections, in particular multi-level road intersections involving several lanes of traffic on two or more roads crossing each other.

BACKGROUND OF THE INVENTION

Conventional methods of traffic control and road construction of road intersections cause many instances of traffic interruption which in turn cause vehicular accidents or blockage of the road by vehicles at such intersections.

One approach to solving the above traffic interruption problems is set out in the present Applicant's U.S. Pat. No. 4,986,692 relating to road intersection construction for traffic control. There is described therein a safety island provided longitudinally parallel to the main road at the center line of the intersection. The safety island prevents vehicles from the branch road from crossing the intersection. Circular detour roads beneath or above the main road are provided for traffic circulation. Underground passages for motorcycles and pedestrians may be provided beneath the intersection to eliminate interference with car traffic. Cars on the inner lane of the main roadway can then proceed through the intersection without interruption. In particular, U.S. Pat. No. 4,986,692 teaches the provision of a pair of opposed circular detour roads disposed on either side of said intersection, each detour road having an entrance opening off of the outside lane of the main road an exit onto the outside lane thereof proceeding in the opposite direction with each outside lane having an entrance on one side of the intersection and an exit on the other.

However, although the road intersection construction set out in U.S. Pat. No. 4,986,692 may be eminently suitable for a rural environment where land space is not necessarily at a premium, and vehicle speeds on the main road and the detour roads tend to be relatively high, it is unsuitable for an urban environment where vehicular speeds tend to be lower and efficient utilization of land space is regarded as being of great importance.

Furthermore, the complications of traffic noise, air pollution, vehicle accidents, and congestion in the vicinity of and on a complex road intersection system in an urban environment frequently render the appearance of such an intersection system visually unattractive.

It is, therefore, an objective of the present invention to provide an improvement to the road intersection construction of U.S. Pat. No. 4,986,692 wherein efficient utilization of land space is maximized. It is also another objective of the present invention to integrate a road intersection construction as far as possible into an urban environment in an attractive manner, both visually and with respect to air and noise pollution.

SUMMARY OF THE INVENTION

According to the present invention there is provided a road intersection comprising: a main road having at least two traffic lanes in each direction and an inside and an outside lane in each direction having parallel center lines; a secondary road having at least one traffic lane in each direction intersecting said main road; a traffic island in said intersetion extending parallel to and disposed between the inside lanes of said main road blocking the lanes of said secondary road; a pair of opposed detour roads disposed on either side of said intersection, each detour road being located in a vertical stacking relationship with the main road; wherein the land space lying vertically under said each detour road is substantially within the boundaries of the land space vertically under the main road.

A said detour road may cross the main road on a bridge thereover; alternatively, it may cross the main road in a tunnel thereunder.

Preferably, each said detour road is provided with an entrance opening off of the outside lane of said main road an an exit onto the outside lane thereof proceeding in the opposite direction with each outside lane being provided with an entrance on one side of the intersection and an exit on the other.

The intersection preferably further comprises a pair of tunnels each having an entrance from an outer lane of said main road upstream of said intersection and an exit onto the outer lane downstream of said intersection for pedestrians or motorcycles.

The intersection may be covered over with a top level adapted as a pedestrianized area; the top level may be provided with vegetation.

The invention and its objectives will become apparent with reference to the drawings and following description wherein:

DESCRIPTION OF THE PREFERRED EMBODIMENT

In the following description the road intersection system of the invention will be described with reference to the right hand rule of the road for driving vehicles, as is used in the USA, continental Europe, and most other countries. The invention is, of course, applicable to a road intersection used according to the left hand rule of the road, as is used, for example in the United Kingdom; in this case the drawings and description may be understood by interchanging left with right, mutatis mutandis.

Figure 1:
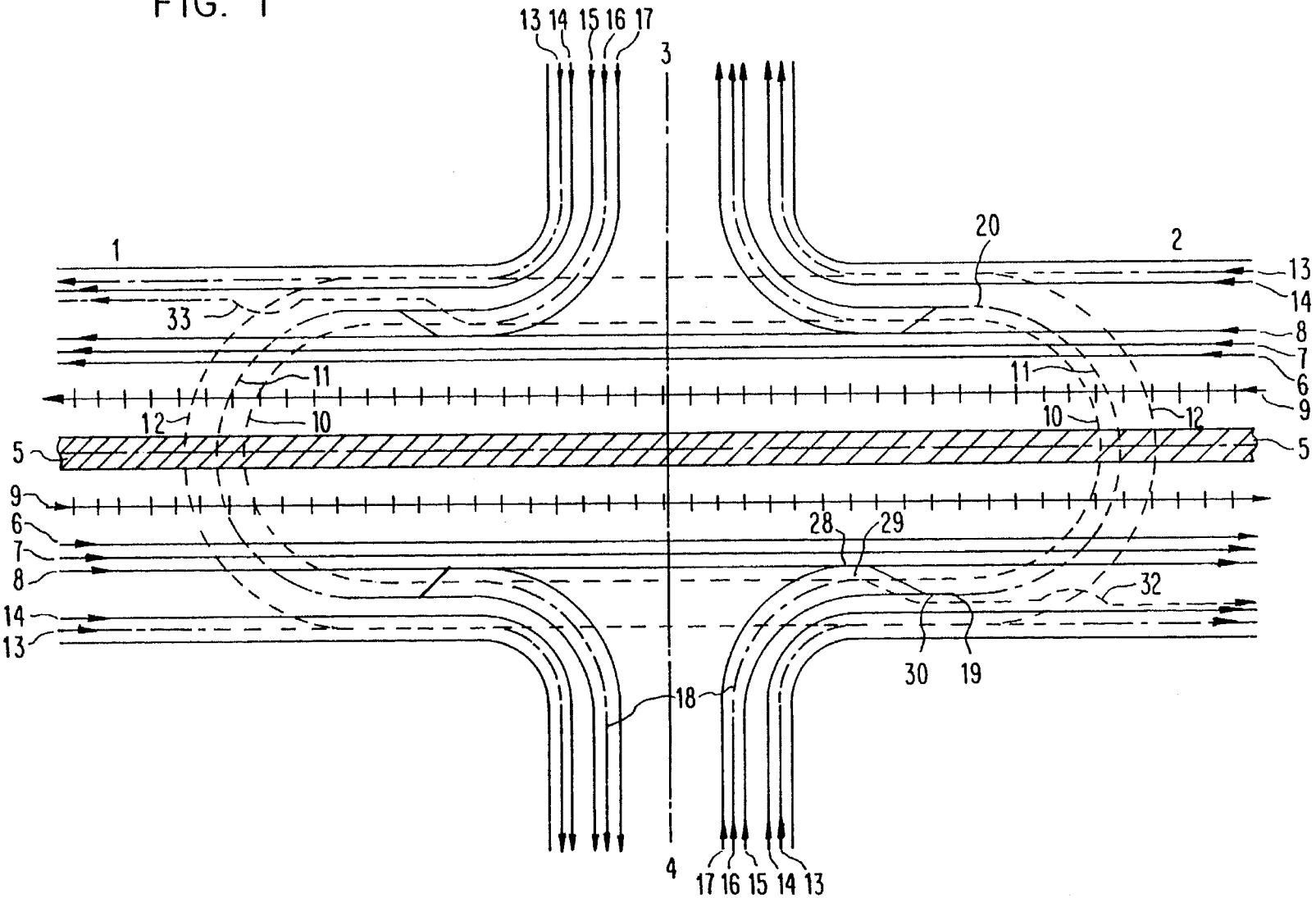
FIG. 1 is a plan view of a multi-level road intersection according to the present invention.

Referring to FIG. 1 there is shown a main road 1,2 and branch roads 3,4 on opposite side of, and at the same level as, the main road, and at right angles thereto. For convenience in the description, the branch roads 3,4 will be referred to as extending north-south. There is provided a safety island 5 (or central reservation) located along the center line of the main road 1,2 so as to separate traffic travelling on both sides of the main road and also preventing the brand roads 3,4 from directly crossing over the main road.

There are a number of lanes provided on each side of the main road 1,2 indicated as follows, reading from the safety island 5 towards the edges of the main road: a rail track 9; an express car lane 6; a slow speed car lane 7; a lane 8 for a car to leave the main road 1,2; a car lane 14 for making a right turn; and a motorcycle lane 13.

Underneath the main road 1,2 is a set of detour or slip lanes 10,11,12 which enable traffic to pass from the northern branch road 3 onto the main road 1,2 (in either direction), or to continue southwards onto the southern branch road 4, or to return northwards on branch road 3. Likewise, on the other side of the intersection a second set of detour lanes 10,11,12 also enable traffic to pass from the southern branch road 4 onto the main road 1,2 (in either direction), or to continue northwards onto the northern branch road 3, or to return southwards on branch road 4. Detour lanes 12 are intended primarily for motorcycle traffic, and lanes 10,11 for cars.

Each set of detour lanes 10,11,12 comprises a detour road which is provided with an entrance opening off of the outside lane of the main road 1,2 and an exit onto the outside lane thereof proceeding in the opposite direction with each outside lane being provided with an entrance on one side of the intersection and an exit on the other.

The detour lanes 10,11,12 are semicircular and have the same diameter as the width of the main road 1,2, and are stacked vertically with respect to the main road so that they lie vertically thereunder and occupy the same land space as the main road. Hence, unlike the prior art, the detour lanes do not occupy any land space outside the area occupied by the roads 1,2 and 3,4. This is clearly a significant advantage in an urban environment where land space is expensive and will reduce popular opposition to construction works. It is also believed that the width of all roads above 30 meters in an urban area are available to be reformed in this way for alleviating traffic problems in a city. This is made easier to achieve because the slower speed of traffic in a city means that the detour lanes 10,11,12 can have a relatively small radius of curvature, whereas in a rural environment, where traffic speeds are much higher, detour lanes of necessity have a larger radius of curvature and extend outside the land space covered by a junction.

The branch roads 3,4 are provided with a number of lanes, reading from the center line of each branch road towards its edge, as follows: 17 a car lane for right turn, straight across, left turn and go around turn, 16 a car lane for right turn, straight across, left turn and go around turn, 15 a car lane for straight across, left turn and go around turn, 14 a car lane for right turn, 13 a motorcycle lane, respectively through the detour lanes 10,11,12. Lines 18,19,20 show the donwards or upwards direction of cars as they enter or leave the detour lanes 10,11,12. Curve lines 32,33 show the passage of a car under the motorcycle circular detour lane 12.

Merging points 28,29,30 are provided for lanes entering or leaving the detour lanes 10,11,12 from the branch roads 3,4 or main road 1,2. It is suggested that cars at the merging points 28,29,30 follow the principle that cars proceeding along a main highway have precedence over cars merging in, but this may be modified if desired by using traffic signals for particularly heavy traffic conditions.

Figure 2:
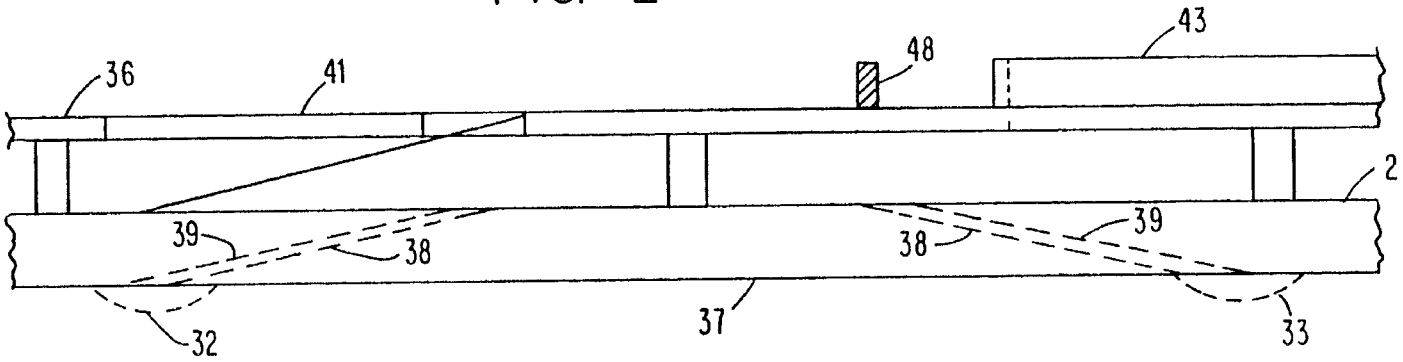
FIG. 2 is a sectional side view of the intersection of FIG. 1, with a top layer added.
Figure 3:
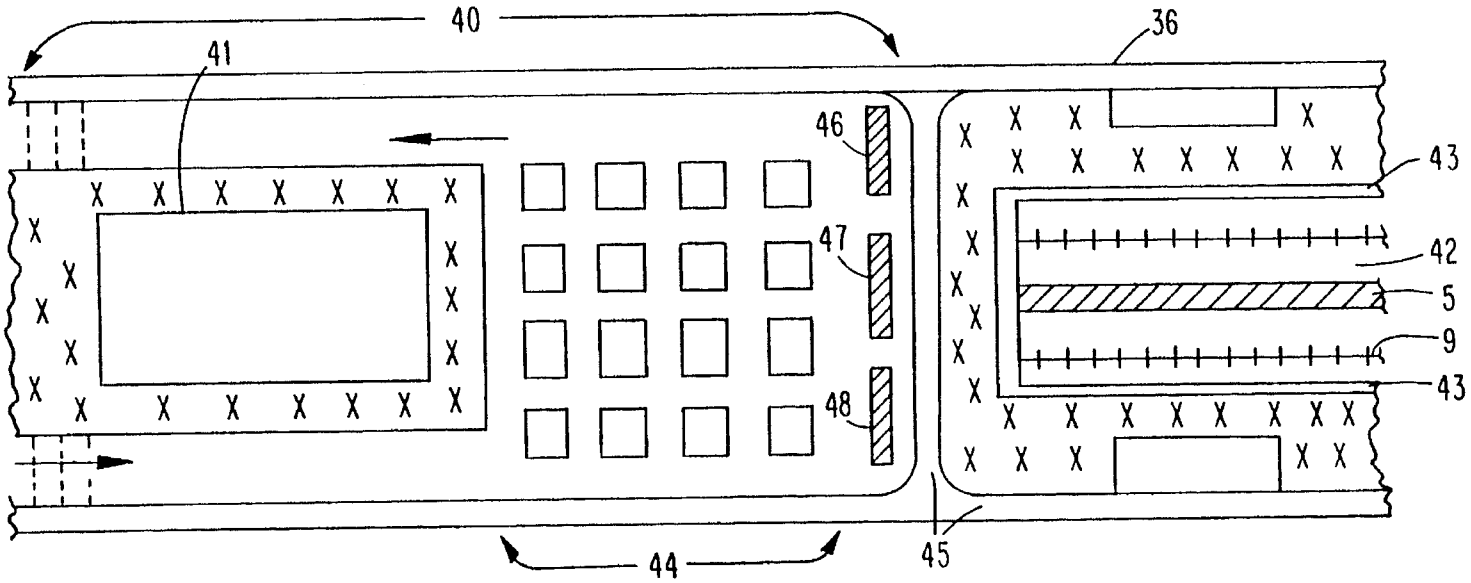
FIG. 3 is a plan view of the top layer referred to in FIG. 2.

Referring to FIGS. 2 and 3, the road junction system of FIG. 1 is shown provided with a top level 36 which is not intended for use by moving traffic, but is instead intended for use by pedestrians or for parking and may, at least in part, as shown in FIG. 3 be covered in vegetation, thus enhancing the environmental appeal of the road junction system. The circular detour lanes 10,11,12 are directed by 38,39 onto the base 37 at the intersection of the roads for the elimination of traffic conflict. A silent zone 40 is provided by an area of thick glass 41, and open at 42 for air circulation with a protecting fence 43. Pedestrian sidewalks 44,45 are provided on the top level 36, and 46,47,48 are obstructions, the rest of the top surface being for vegetation. Level 36 is reached by ramp 34 and is left by ramp 35. See FIG. 2.

Although the detour lanes 10,11,12 are described herein with reference to the Figures as passing under the main road 1,2 in an alternative embodiment (not illustrated) one or more may be arranged to pass over the main road if so desired.

I claim:

1. A road intersection comprising:

a main road having at least two traffic lanes in each direction and an inside and an outside lane in each direction having parallel center lines;

a secondary road having at least one traffic lane in each direction intersecting said main road;

a traffic island in said intersection extending parallel to and disposed between the inside lanes of said main road blocking the lanes of said secondary road;

a pair of opposed detour roads disposed on either side of said intersection each detour road being located in a vertical stacked relationship with the main road, and each detour road having an entrance opening off of the outside lane of said main road and an exit onto the outside lane thereof proceeding in an opposite direction with each outside lane being provided with an entrance on one side of the intersection and an exit on the other, wherein the land space lying vertical under each detour road is substantially within the boundaries of the land space vertically under the main road.

2. The road intersection as claimed in claim 1 wherein said detour road is adapted to cross the main road on a bridge thereover.

3. The road intersection of claim 1 wherein said detour road is adapted to cross the main road in a tunnel thereunder.

4. The road intersection of claim 1 wherein said intersection further comprises a pair of tunnels, each having an entrance from an outer lane of said main road upstream of said intersection and an exit onto the outer lane downstream of said intersection for pedestrians or motorcycles.

5. The road intersection of claim 1 wherein said intersection is covered with a top level adapted for pedestrian use.

6. A road intersection as claimed in claim 5 wherein said top level is provided with vegetation.

* * * * *